United States Patent [19]

Prober

[11] Patent Number: 4,479,979

[45] Date of Patent: Oct. 30, 1984

[54] METHOD FOR INDICATING AN INSUFFICIENT LEVEL OF YARN FINISH

[75] Inventor: James M. Prober, Centreville, Del.

[73] Assignee: E. I. Du Pont de Nemours and Company, Wilmington, Del.

[21] Appl. No.: 563,051

[22] Filed: Dec. 19, 1983

[51] Int. Cl.[3] ..... B05D 7/00; G01K 13/00

[52] U.S. Cl. ..... 427/9; 73/160; 374/141; 427/175

[58] Field of Search ..... 118/665, 666, 667, 712, 118/713, DIG. 22; 374/144; 73/160; 427/175

[56] References Cited

U.S. PATENT DOCUMENTS

| | | | |
|---|---|---|---|
| 3,207,125 | 9/1965 | Strandberg, Jr. | 118/665 |
| 3,287,977 | 11/1966 | Marshall, Jr. et al. | 73/160 X |
| 3,393,661 | 7/1968 | Sharp | 118/411 |
| 3,422,796 | 1/1969 | Baber | 118/419 |
| 3,523,414 | 8/1970 | Black et al. | 57/265 |
| 4,345,205 | 8/1982 | Sung | 118/665 X |

*Primary Examiner*—Evan K. Lawrence

[57] ABSTRACT

Insufficient finish level on a yarn may be detected by monitoring the temperature of a stationary surface over which the yarn runs and observing a rise in temperature above that seen when a normal fixed level of finish is present on the yarn.

2 Claims, 6 Drawing Figures

FIG. 1
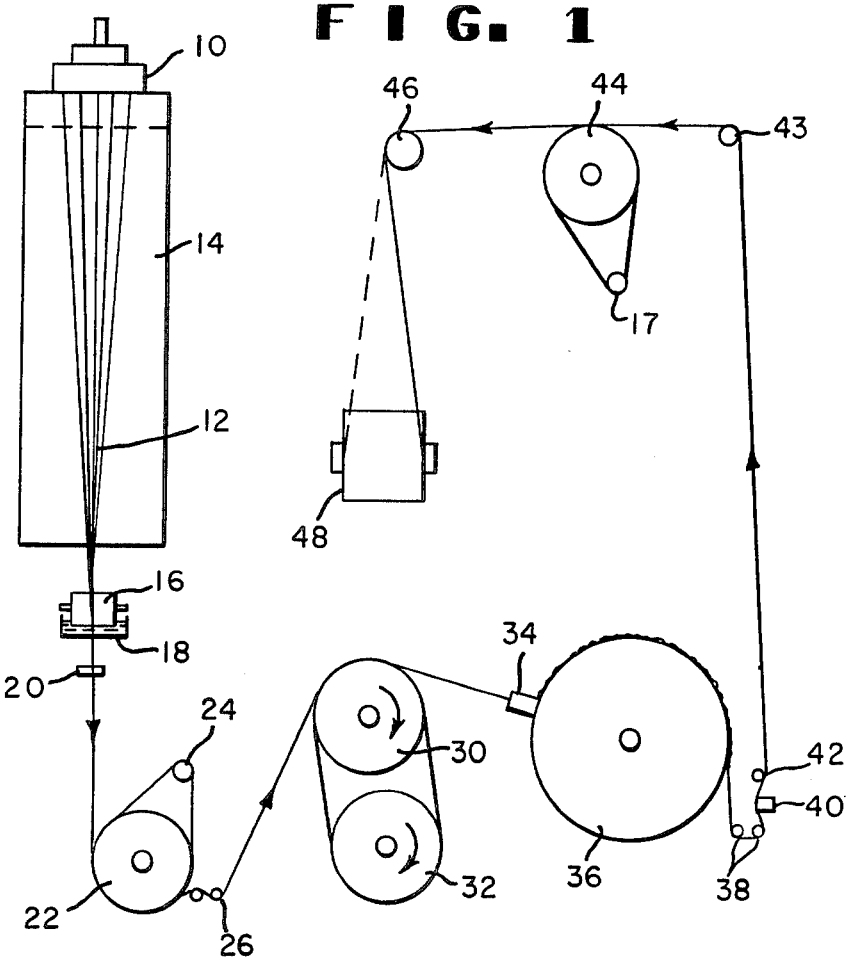
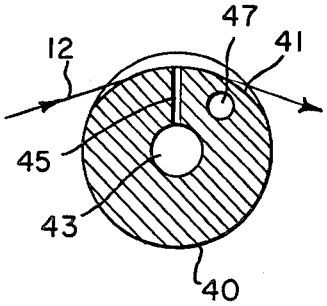
FIG. 3
FIG. 2
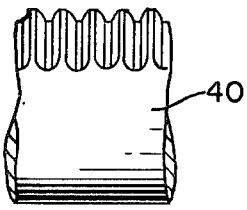
FIG. 4
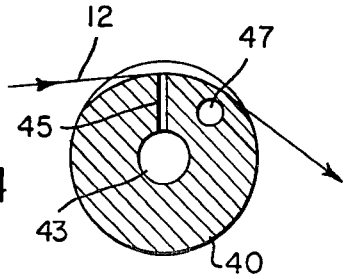

WHERE:

| | |
|---|---|
| XN | REPRESENTS THE SIGNAL FROM THREADLINE N (1, 2, ...56) |
| $XN_{i-1}$ | REPRESENTS THE PENULTIMATE SIGNAL FROM THREADLINE N |
| YN | REPRESENTS A PRESET ALARM LEVEL |
| Z | REPRESENTS A PRESET TEMPERATURE CHANGE LEVEL |

SIGNAL WILL MOST LIKELY BE A WARNING LIGHT LOCATED AT THE POSITION ITSELF OR IN A PANEL/CONTROL ROOM

METHOD FOR INDICATING AN INSUFFICIENT LEVEL OF YARN FINISH

BACKGROUND OF THE INVENTION

This invention relates to a method for detecting an insufficient level of finish on yarn, more particularly, it relates to detecting such levels by monitoring the temperature of a stationary surface over which the yarn advances.

Substances known as finishes are usually applied to synthetic polymeric filaments for lubrication to reduce friction as they advance over guides, draw pins and other machine elements in various yarn handling processes. Finishes may also be applied to reduce the generation of static electricity, conduct such charges away, or provide soil or stain resistance capability to the yarn.

If the supply or application of finish is interrupted or greatly reduced, the yarn handling process may break down or the product will be unsatisfactory to the customer. Since finishes are usually colorless, the absence of finish even on the outside of a yarn package is difficult to detect, and a temporary interruption of finish within a yarn package is usually impossible to determine.

Methods of detecting the presence or absence of finish are known, employing instruments which respond to some characteristic of the finish such as conductance. However, such devices are often quite expensive and difficult to maintain, when each threadline of a multi-threadline machine must be inspected.

SUMMARY OF THE INVENTION

It has now been found that insufficient or missing finish may be detected by monitoring the temperature of a stationary surface over which the yarn runs at or downstream of the place at which finish is applied and observing a rise in temperature above that seen when a normal amount of finish is present due to increased friction between the yarn and such surface.

The detecting device may be a thermocouple, thermistor or other temperature sensing device coupled to a monitoring system. Such devices are quite low in cost and small in size but are capable of detecting any desired range of temperature rise rapidly and accurately.

For some purposes, it will be satisfactory to sense that the temperature has exceeded a predetermined level. For other purposes, it may be necessary to detect a rise in temperature of a certain amount over "normal", or to detect a certain temperature-time profile. (e.g. the rate of temperature rise.)

In some processes finish is applied to a yarn at two different locations, one just after extrusion and one before winding, and these finishes may be of different types for different purposes. When failure of the second finish must be monitored, the friction and temperature increase sensed by a detector after the second finish applicator may not be large due to the presence of the first finish. In such case, the second detector may need to be more sensitive than the first and be capable of registering a smaller temperature rise.

The instrumentation for reading the outputs of electrically-operated temperature detectors may be of any required degree of sensitivity. Each detector may be monitored once for each yarn package produced, or each may be monitored continuously. When a preselected temperature or temperature rise has been exceeded, an alarm or warning light may be activated, or in a completely automated system, the package on a faulty position may be rejected.

Since the temperature rise depends on the amount of frictional heat generated between the filaments and the surface near which the temperature detector is located, various means may be employed to maximize friction and the transmittal of frictional heat to the detector while minimizing radiation or conduction of heat away from the detector. For example, a higher tension or larger angle of contact of yarn across a surface or a surface having higher coefficient of friction with dry yarn will generate greater heat, while a material having high thermal conductivity between the surface and detector will transmit heat more effectively. It has been found that hardened Type 440 stainless steel or matte chromium plating over steel have adequate wear resistance, coefficient of friction and thermal conductivity to give a useful temperature rise, whereas conventional ceramic guide material has low coefficient of friction and conductivity. If ceramic is desired, a special formulation may be needed. Conduction of heat away from the detector may be minimized by reducing the mass of the friction element, particularly of pathways which provide large heat sinks.

BRIEF DESCRIPTION OF THE DRAWINGS

FIG. 1 shows schematically a synthetic yarn production process and several places where temperature detectors may advantageously be located.

FIGS. 2 and 3 are front and cross-sectional views of a typical orifice applicator with a temperature detecting device installed and showing a threadline path across the applicator.

FIG. 4 is similar to FIG. 3 but shows a different threadline path.

DETAILED DESCRIPTION OF THE PREFERRED EMBODIMENT

Figure 5:
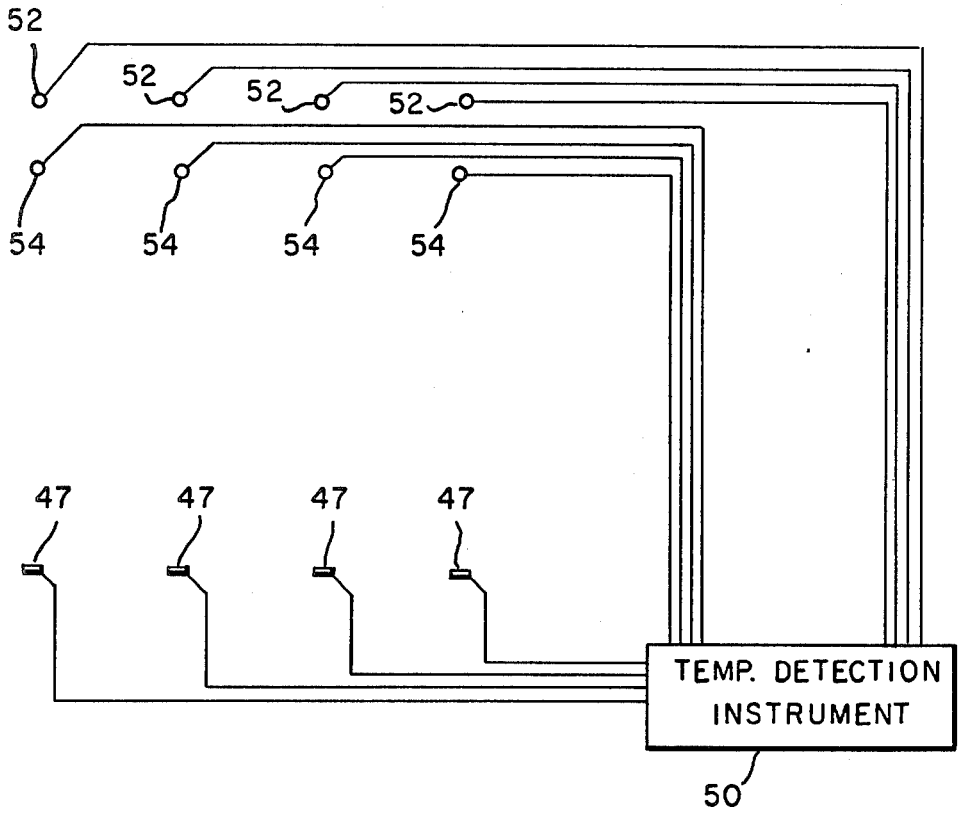
FIG. 5 is a schematic diagram of a preferred monitoring system for reading temperatures and indicating off-standard finish conditions.

The embodiment chosen for purposes of illustration includes a spinneret 10 from which filaments 12 are extruded and passed through an air quenching chimney 14, after which they pass over finish roll 16 which picks up liquid finish from an associated pan 18 and deposits it on filaments 12. The filaments then pass over convergence guide 20 which may have a temperature detector installed to detect absence of the first (primary) finish. Feed roll 22 and separator roll 24 regulate the speed at which filaments are taken away from spinneret 10 and fed to stationary draw pins 26 and draw rolls 30, 32 which rotate several times faster than feed roll 22. A temperature detector may alternatively be installed in draw pins 26, though the normal operating temperature is quite high and special arrangements may need to be made for detecting an incremental temperature rise due to low or missing primary finish. If filaments 12 are to be crimped, they may pass next into a heated jet device 34 wherein turbulent hot air or steam forwards and crimps them while depositing them on foraminous cooling drum 36 rotating at a much slower speed than draw rolls 30, 32. This treatment may remove most of the primary finish from the filaments, requiring application of another (secondary) finish of the same or different type. After cooling, filaments are taken off drum 36 over rollers or stationary guides 38 and then pass over secondary finish applicator 40 which may be of the type shown in FIGS. 2 and 3. Take-up roll 44 regulates the speed and tension of the yarn as it is wound on package 48. Lack of secondary finish may be detected by installing a temperature sensor in guides 42 or 43, or in applicator 40 if it is of a type shown in FIGS. 2 and 3.

An applicator 46 of the type shown in FIGS. 2, 3 and 4 may advantageously be used in a position where the yarn leaving the applicator goes directly to windup package 48. In this position, it is preferred that the axis of the applicator be perpendicular to the axis of the package so that the traverse motion changes the degree of wrap of the yarn on the applicator rather than oscillating the yarn from side to side in the applicator slot.

FIGS. 2 and 3 are two views of one typical orifice applicator such as 40 as disclosed in Baber U.S. Pat. No. 3,422,796. In FIG. 3, filaments 12 are seen frictionally contacting a surface 41 of finish applicator 40 at a location where finish liquid is metered under pressure through central bore 43 and outwardly into contact with the filaments through orifice 45. Thermocouple 47 is inserted into a hole in the applicator 40, preferably downstream of orifice 45.

FIG. 4 shows an alternate threadline path in which contact between the filaments 12 and the applicator 40 is minimized on the upstream side of orifice 45 and maximized on the downstream side near the temperature sensing device 47.

Referring to FIG. 3 and FIG. 5, a thermocouple 47 is installed in finish applicator 40 to detect low or missing finish on each threadline of filaments 12 of a multiposition spinning machine. The electrical signal from each thermocouple 47 is led to a centrally-located temperature detection instrument 50 which is commercially available from Kaye Instruments Inc. as a model RD36 Ramp Processor combined with a model 128RR Ramp Scanner. When increased temperature at a position is detected, instrument 50 determines, as more fully described below, whether or not an alarm light 52 at that particular position is activated. An audible alarm to alert the machine operator may also be activated. The operator may then press a reset button 54 at the nonstandard position, which will turn off the light and alarm if the excessive temperature was only temporary. If the excessive temperature persists, the operator will search for and correct the cause of inadequate finish on yarn, will remove the package of yarn containing the off-standard condition, and will press reset button 54 again, before starting to wind a new package. A similar detection system may be used for sensors in any of the alternate locations in the process.

Figure 6:
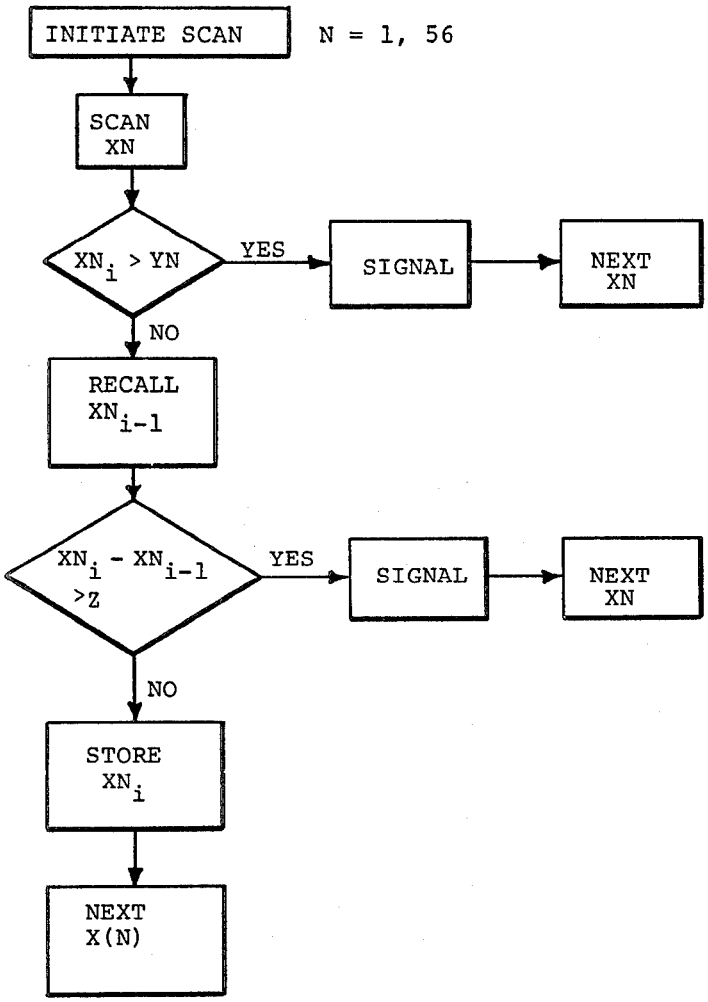
FIG. 6 is a logic flow diagram for the signal processor.

The logic for the operation of the temperature detection instrument 50 which looks at each position separately is best described by referring to FIG. 6.

For some purposes, it will be satisfactory to sense that the temperature (XNi) has exceeded a predetermined level (YN). Alternately, it may be necessary to detect a certain rate of temperature rise, wherein the final temperature has not yet exceeded said predetermined level. In such a case, it would be necessary to recall earlier signals (XNi-1) which would serve as the initial temperature reading. Several devices can be used as a detection instrument 50 for monitoring excursions beyond a predetermined set point as well as detection of a temperature rise per unit of time. These include electronic computers and/or programmable controllers, and/or limited capability data loggers. Inherent requirements of such a system would include digital to analog conversion of said signal, a minimum arithmetic and storage capability, and, if necessary, alarm relays.

While the illustrated embodiment shows the temperature sensing device 47 inserted in a finish applicator 40, the sensing device may be inserted or embedded in a yarn guide or other machine element, preferably an existing one so that no extra friction elements need be added. Conversely, the sensing device may be coated with ceramic or plated with chromium so that it may act as both friction surface and temperature detector.

I claim:

1. The method of indicating a lower level of finish on a yarn than an essentially constant level applied to the yarn, said essentially constant level being represented by a set point amplitude, said method comprising: passing the yarn over a stationary-surfaced machine element; measuring the temperature of said machine element; generating a signal proportional to said temperature; comparing the amplitude of said signal to said set point amplitude; and signalling when said signal amplitude exceeds said set point amplitude, thereby indicating a lower level of finish than said essentially constant level.

2. In a process for handling yarn in one or more steps wherein the yarn is advanced from one step to the next over a stationary-surfaced machine element and wherein a liquid finish is applied to the yarn at an essentially constant level at one or more locations to facilitate its handling, the method of indicating a lower level of finish on the yarn than said essentially constant level, said essentially constant level being represented by a set point amplitude, said method comprising: measuring the temperature of a machine element located downstream from said one or more locations; generating a signal proportional to said temperature; comparing the amplitude of said signal to said set point amplitude; and signalling when said signal amplitude exceeds said set point amplitude, thereby indicating a lower level of finish than said essentially constant level.

* * * * *